US008387200B1

(12) United States Patent
Woodhouse

(10) Patent No.: US 8,387,200 B1
(45) Date of Patent: Mar. 5, 2013

(54) CLEANING APPARATUS

(76) Inventor: Sharyn Amii Woodhouse, Corona Del Mar, CA (US)

( * ) Notice: Subject to any disclaimer, the term of this patent is extended or adjusted under 35 U.S.C. 154(b) by 948 days.

(21) Appl. No.: 12/150,039

(22) Filed: Apr. 24, 2008

Related U.S. Application Data

(60) Provisional application No. 60/926,843, filed on Apr. 30, 2007.

(51) Int. Cl.
*A47L 15/37* (2006.01)

(52) U.S. Cl. ..... 15/211; 15/212

(58) Field of Classification Search ..... 15/164, 15/165, 211, 212, 213, 114, 26
See application file for complete search history.

(56) References Cited

U.S. PATENT DOCUMENTS

| | | | | |
|---|---|---|---|---|
| 344,267 | A | 6/1886 | Goulding | |
| 564,497 | A | 6/1896 | Basis | |
| 824,994 | A | 7/1906 | Livermore | |
| 1,760,695 | A * | 5/1930 | Hertzberg | 15/120.2 |
| 1,936,433 | A * | 11/1933 | Jumonville | 15/208 |
| 2,162,677 | A | 6/1939 | Reynolds | |
| 2,170,740 | A | 8/1939 | Volckening | |
| 2,432,924 | A * | 12/1947 | Nishizaka et al. | 15/212 |
| 2,566,621 | A | 9/1951 | Meyer | |
| 2,653,334 | A | 9/1953 | Bay | |
| 3,133,298 | A | 5/1964 | Norwood | |
| 3,205,518 | A * | 9/1965 | Romaine | 15/104.165 |
| 3,205,527 | A | 9/1965 | Laird | |
| 3,675,263 | A | 7/1972 | Durham | |
| 4,502,176 | A | 3/1985 | Wallace | |
| 4,614,449 | A | 9/1986 | Korfgen et al. | |
| D362,966 | S | 10/1995 | Timmons | |
| 5,479,951 | A * | 1/1996 | Denebeim | 132/265 |
| 7,017,222 | B2 | 3/2006 | Dunn | |
| 2003/0056809 | A1 * | 3/2003 | Horton | 134/8 |
| 2006/0260077 | A1 * | 11/2006 | Wilson | 15/104.16 |

* cited by examiner

*Primary Examiner* — Robert Scruggs
(74) *Attorney, Agent, or Firm* — Berenato & White, LLC

(57) ABSTRACT

A flexible cleaning apparatus including a cleaning mechanism manipulated by expanding and stretching into an elongated narrow form for insertion into a small or narrow opening of a container, and once inserted, the flexible cleaning mechanism can be manipulated further, external the opening, by contracting and scrunching into various condensed mass forms for concentrated cleaning of the interior of the container.

5 Claims, 13 Drawing Sheets

CLEANING APPARATUS

CROSS-REFERENCE TO RELATED APPLICATIONS

This application claims the benefit of priority of the U.S. Utility Provisional Patent Application No. 60/926,843, filed Apr. 30, 2007, the entire disclosure of which application is expressly incorporated by reference in its entirety herein.

BACKGROUND OF THE INVENTION

1. Field of the Invention

This invention relates to a cleaning apparatus and, more particularly, to a flexible cleaning mechanism that can be manipulated for insertion through a small opening and once inserted, it can be manipulated further into different forms and dimensions for cleaning.

2. Description of Related Art

Conventional cleaning devices are well known and have been in use for a number of years. Reference is made to the following few exemplary U.S. patent Publications, including U.S. Pat. Nos. 7,017,222; 4,614,449; 4,502,176; 3,675,263; 3,205,527; 3,133,298; 2,653,334; 2,566,621; 2,170,740; 2,162,677; 824,994; 564,497; 344,267, Des 362,966. Regrettably, most prior art conventional cleaning devices suffer from obvious disadvantages in that they cannot be inserted through narrow or small openings of unusual or peculiar shaped containers, nor can they be used for cleaning odd shaped interior cavities and surfaces. Most conventional prior art cleaning devices include a brush that is comprised of bristles that are coupled to rigid or semi-rigid stem or handle of the cleaning device. Cleaning devices with narrow width brush heads and semi-rigid handles may be used for insertion through a narrow opening of a container, but once inserted, they cannot be easily manipulated or controlled further to conform and be used for cleaning unusual surfaces or cavities within the interior chamber of the container.

Other conventional method for cleaning an irregular shaped container (e.g., narrow opening, unusual surfaces or cavities within the interior of the container, etcetera) is to place water and detergent inside the container and swirl the soapy water within for cleaning. Others may also add small beads to the soapy water and when the container is swirled, the beads move and contact the interior surface of the container and through friction loosens the dirt residue. Another method is to use a simple cleaning rag, which is forcefully stuffed through the narrow opening to within the container for better cleaning. However, the cleaning rag cannot be directed to clean various odd shaped cavities or surfaces that may exist within the interior surface of the container.

Accordingly, in light of the current state of the art and the drawbacks to current cleaning devices mentioned above, a need exists for a cleaning apparatus that would easily be inserted into a narrow opening of a container, and that would be controlled and manipulated external the container to modify or change the shape of the cleaning apparatus commensurate with the variations of the interior surface of the container for cleaning.

BRIEF SUMMARY OF THE INVENTION

One preferred, non-limiting aspect of the present invention provides a cleaning apparatus, comprising a flexible cleaning mechanism manipulated into an elongated narrow form for insertion into a small opening. Once inserted, the flexible cleaning mechanism can be further manipulated external the small opening into various condensed mass forms for cleaning.

One optional aspect of the present invention provides a cleaning apparatus, wherein the flexible cleaning mechanism is expanded and stretched into the elongated narrow configuration for insertion through a narrow passage, and contracted and scrunched into the condensed mass form for cleaning.

Another optional aspect of the present invention provides a cleaning apparatus further comprising:

an outer member;

an inner member;

the inner member movably inserted within the outer member;

the cleaning mechanism having a first end coupled with the outer member and a second end coupled with the inner member, with the inner member manipulated to vary the form of the cleaning mechanism, allowing the cleaning mechanism for insertion through the opening, and further manipulated to continuously, progressively vary the form of the cleaning mechanism into various condensed mass forms.

Another optional aspect of the present invention provides a cleaning apparatus, wherein the outer member and the inner member have a substantially curved configuration.

Yet another optional aspect of the present invention provides a cleaning apparatus, wherein the inner member is comprised of a first inner end that couples with the second end of the cleaning mechanism, and is further comprised of a second inner end that is grasped for manipulation.

Still another optional aspect of the present invention provides a cleaning apparatus, wherein the second inner end includes an attachment device for storage of the cleaning apparatus and ease of manipulation of the inner member.

A further optional aspect of the present invention provides a cleaning apparatus, wherein:

the manipulation of the inner member causes the inner member to move within the outer member in a first direction, which pushes the cleaning mechanism away from the outer member, which changes the form of the cleaning mechanism by drawing out and lengthening the cleaning mechanism while reducing width for insertion of the cleaning mechanism through the small opening; and the manipulation of the inner member further causes the inner member to move within the outer member in a second direction, which pulls the cleaning mechanism towards the outer member, which changes the form of the cleaning mechanism by scrunching the cleaning mechanism into a denser form.

Still a further optional aspect of the present invention provides a cleaning apparatus, wherein the cross-section of the outer member is greater than the cross-section of the inner member to allow the inner member to be movably inserted in the outer member.

Yet a further optional aspect of the present invention provides a cleaning apparatus, wherein the outer member has a first longitudinal axial length that is less than a second longitudinal axial length of the inner member, with the second longitudinal axial length of the inner member being greater than a cumulative total length of the cleaning mechanism when in the elongated narrow form and the first longitudinal axial length of the outer member.

Another optional aspect of the present invention provides a cleaning apparatus, wherein the cleaning mechanism is a flexible elongated mesh.

Still another optional aspect of the present invention provides a cleaning apparatus, wherein:

the mesh is comprised of an arranged elongated cylindrical tube mesh bundled closed and folded onto itself at a center thereof to form a dual layer mesh and bundled again to form a dense nodule head portion and a free end portion;

the dense nodule head portion forms the second end of the cleaning mechanism with which the first inner end of the inner member is coupled;

the free end portion of the mesh forms the first end of the cleansing mechanism, which is bundled and coupled with the outer member.

Yet another optional aspect of the present invention provides a cleaning apparatus, wherein the inner member is comprised of one of a hollow and solid structure.

A further optional aspect of the present invention provides a cleaning apparatus, wherein the attachment device is a ring.

Still a further optional aspect of the present invention provides a cleaning apparatus, wherein the outer member, the inner member, and the cleaning mechanism are flexible, allowing the cleaning apparatus to move through the small opening.

An aspect of the present invention provides a method for cleaning, comprising:

manipulating a cleaning mechanism by stretching and elongating the cleaning mechanism into a long and narrow form for insertion within a narrow passage;

scrunching the cleaning mechanism into various condensed forms for cleaning; and re-stretching the cleaning mechanism into a long and narrow form for removal from within the narrow passage.

An optional aspect of the present invention provides a method for cleaning, comprising:

the functional act of manipulating includes:

moving an inner member within an outer member in a first direction, which pushes the cleaning mechanism away from the outer member, which changes the form of the cleaning mechanism by elongating and lengthening the cleaning mechanism while reducing width for insertion of the cleaning mechanism through the narrow passage; and moving the inner member within the outer member in a second direction, which pulls the cleaning mechanism towards the outer member, which changes the form of the cleaning mechanism by scrunching the cleaning mechanism into various denser forms for cleaning.

These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" is used exclusively to mean "serving as an example, instance, or illustration." Any embodiment described as "exemplary" is not necessarily to be construed as preferred or advantageous over other embodiments.

Referring to the drawings in which like reference character (s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

The present invention provides a cleaning apparatus that is comprised of a flexible cleaning mechanism that is manipulated into an elongated narrow form for insertion into a small opening and once inserted, the flexible cleaning mechanism can be manipulated further, external the small opening, into various condensed mass forms and dimensions for further cleaning.

Figure 1A:
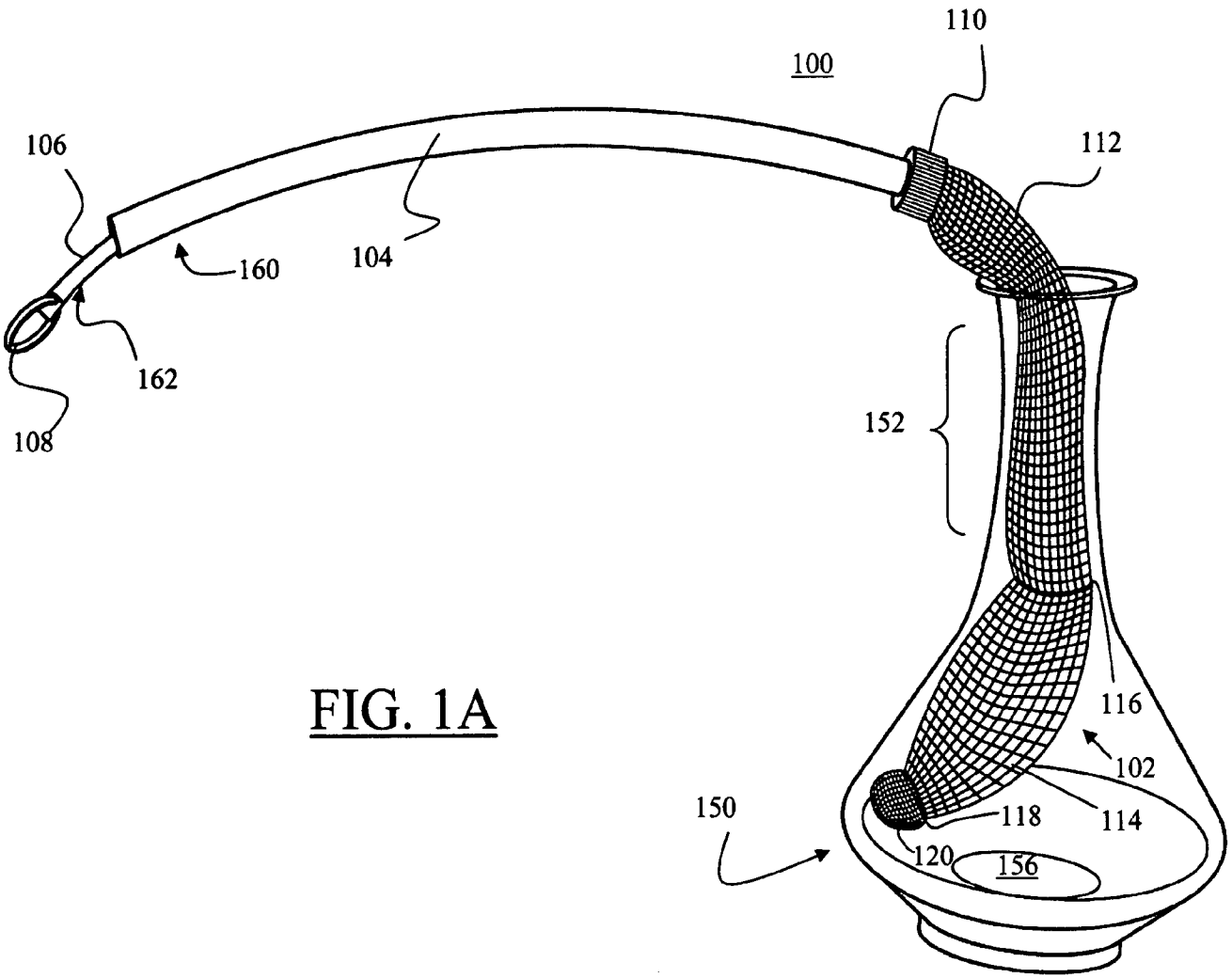
FIG. 1A is an exemplary illustration of a cleaning apparatus for cleaning a container in accordance with the present invention.
Figure 1C:
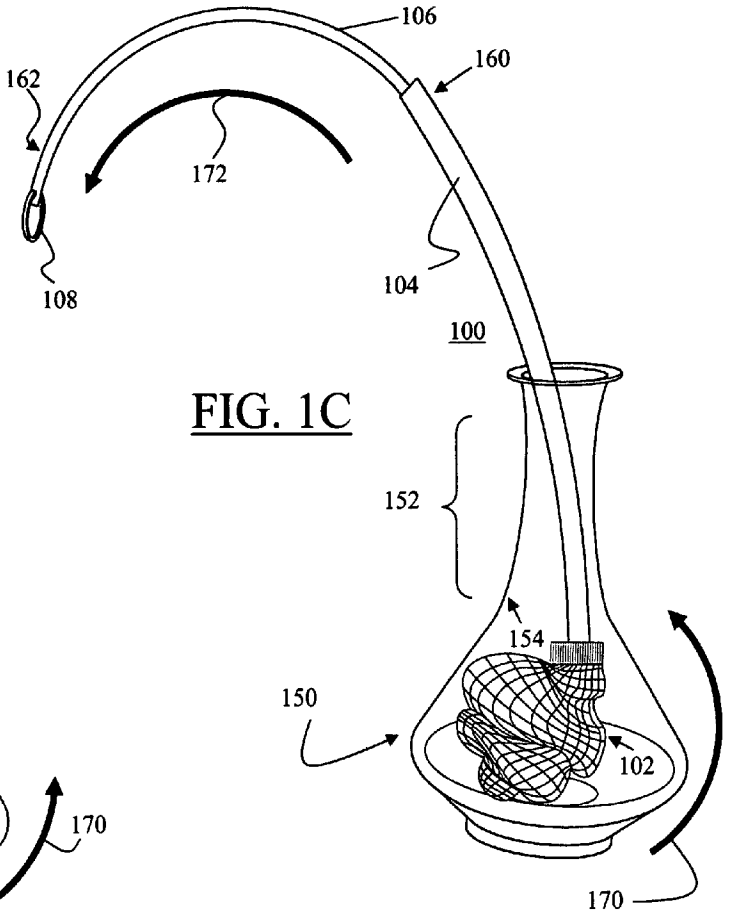
FIGS. 1B and 1C are exemplary illustrations of the cleaning apparatus illustrated in FIG. 1A, but further manipulated for insertion, and then modifications of the form of the cleaning mechanism of the cleaning apparatus external the container in accordance with the present invention.
Figure 1B:
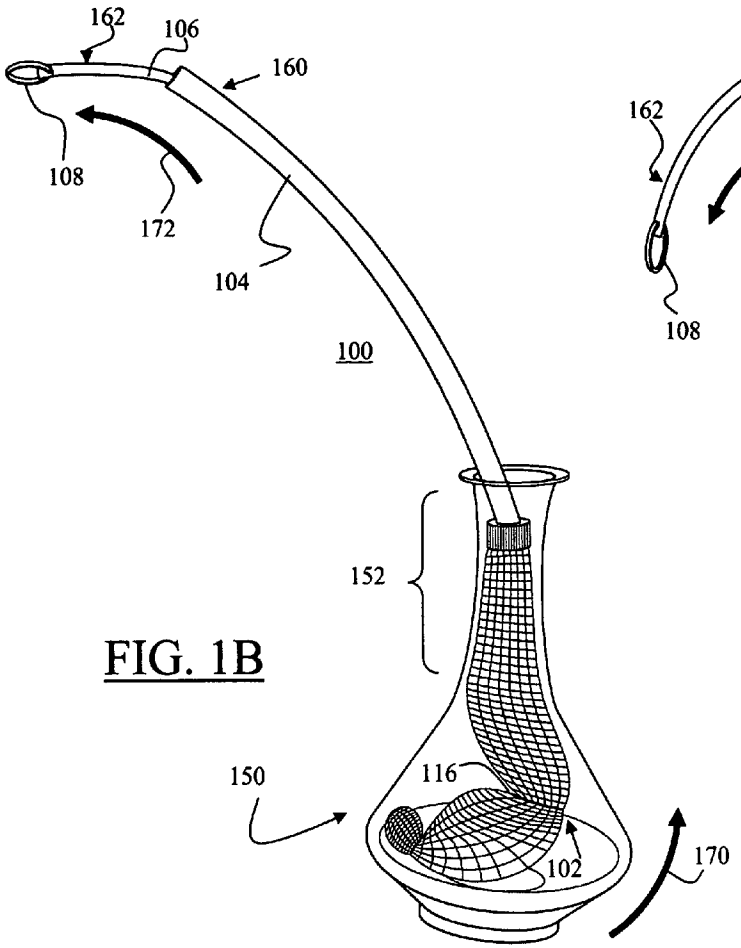

FIG. 1A is an exemplary illustration of a cleaning apparatus in its elongated form for insertion and for cleaning a container in accordance with the present invention. FIGS. 1B and 1C are exemplary illustration of the same cleaning apparatus that is illustrated in FIG. 1A, but further manipulated, from outside the container, to illustrate the various configurations of the cleaning mechanism for cleaning. As illustrated in the exemplary FIGS. 1A to 1C, the present invention provides the cleaning apparatus 100 that is flexible, allowing for easy maneuverability of the cleaning mechanism 102 through narrow passages 152 of containers 150 for cleaning. The cleaning apparatus 100 of the present invention includes the flexible cleaning mechanism 102 that expands, elongates and stretches into a long and narrow form for insertion through a narrow passage 152 of a container 150. Once inserted, the cleaning mechanism 102 can be manipulated further, external the container 150, into different forms and dimensions by contracting and scrunching it into various condensed mass forms for cleaning (as best illustrated in FIGS. 1B and 1C.

Figure 2A:
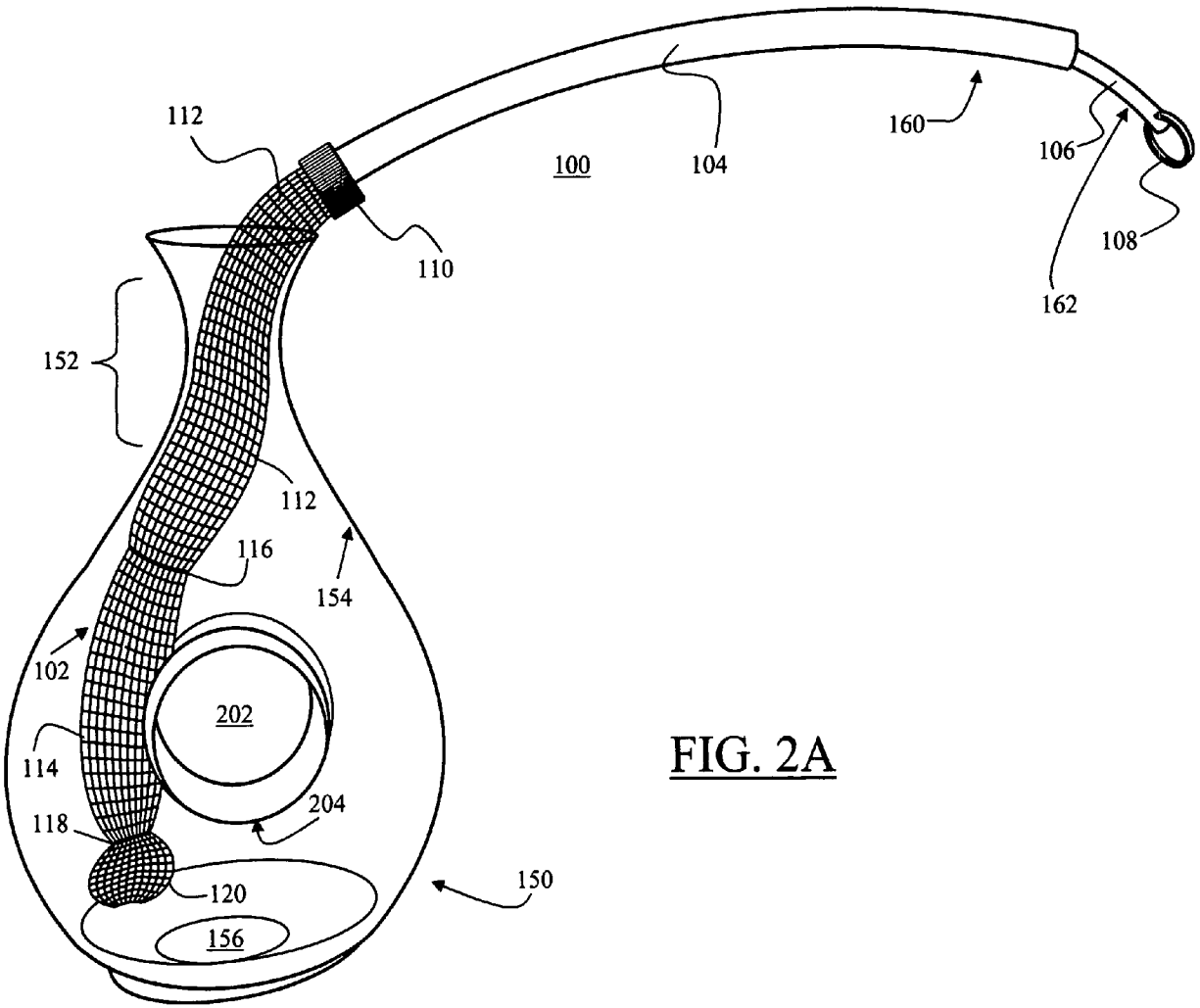
FIG. 2A is an exemplary illustration of the same cleaning apparatus that is illustrated in FIGS. 1A to 1C, but used for cleaning a different and unique shaped container in accordance with the present invention.
Figure 2C:
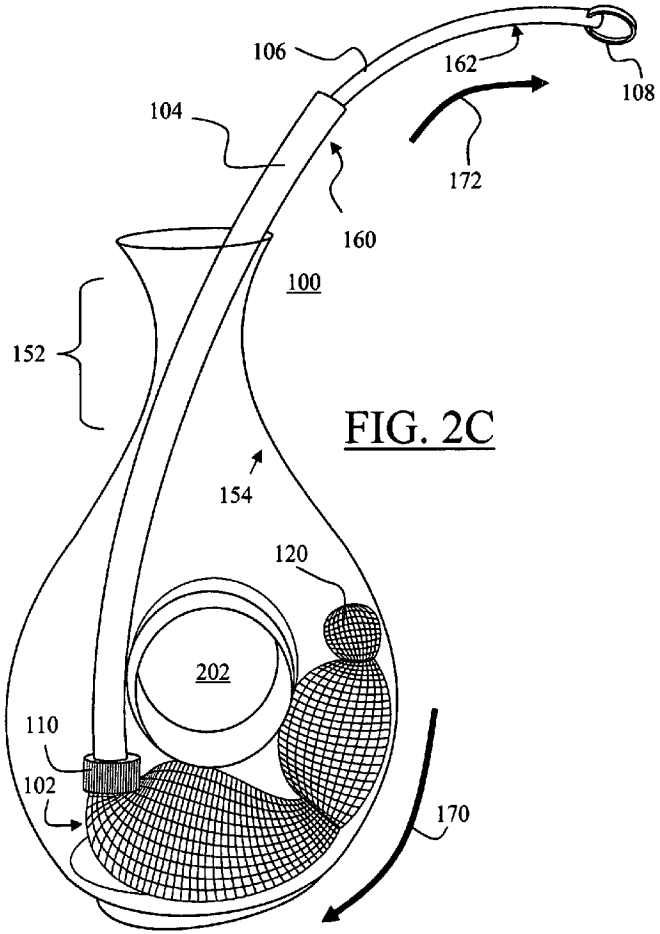
FIGS. 2B to 2E are exemplary illustrations of the cleaning apparatus illustrated in FIGS. 1A to 2A, but manipulated external the container illustrated in FIG. 2A for insertion, and then modifications of the form of the cleaning mechanism of the cleaning apparatus in accordance with the present invention.
Figure 2B:
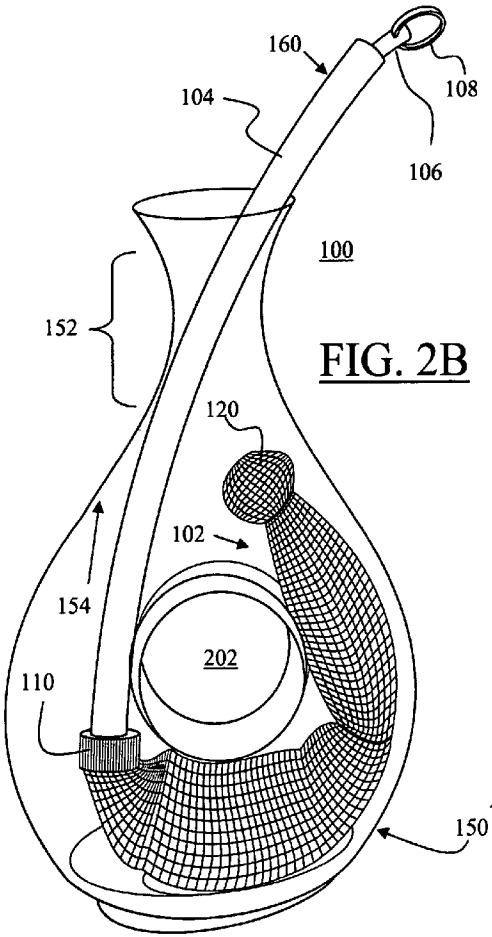

FIG. 2A is an exemplary illustration of the same cleaning apparatus that is illustrated in FIGS. 1A to 1C, but used for cleaning an unusual shaped container with an odd shaped upper side cavity 204 caused by a hole 202 because of the container design. FIGS. 2B to 2E are exemplary illustrations of the cleaning apparatus illustrated in FIGS. 1A to 2A, but manipulated, external the container, for insertion therein and for cleaning. As illustrated in FIG. 2A, the cleaning apparatus 100 is first manipulated by stretching the cleaning mechanism 102 into a long and narrow form for insertion within a narrow passage 152 of the container 150. Thereafter (FIGS. 2B to 2E), the cleaning mechanism 102 is gradually and progressively scrunched into different desired shapes for cleaning, until it reaches its generally spherically condensed form, enabling the cleaning of odd shaped cavities 204 of unusually shaped containers 150 for cleaning. Once container 150 is cleaned, the cleansing mechanism 102 is re-stretched into a long and narrow form (FIGS. 1A and 2A) for removal from within the narrow passage 152 of the container 150.

Figures 2D, 2E:
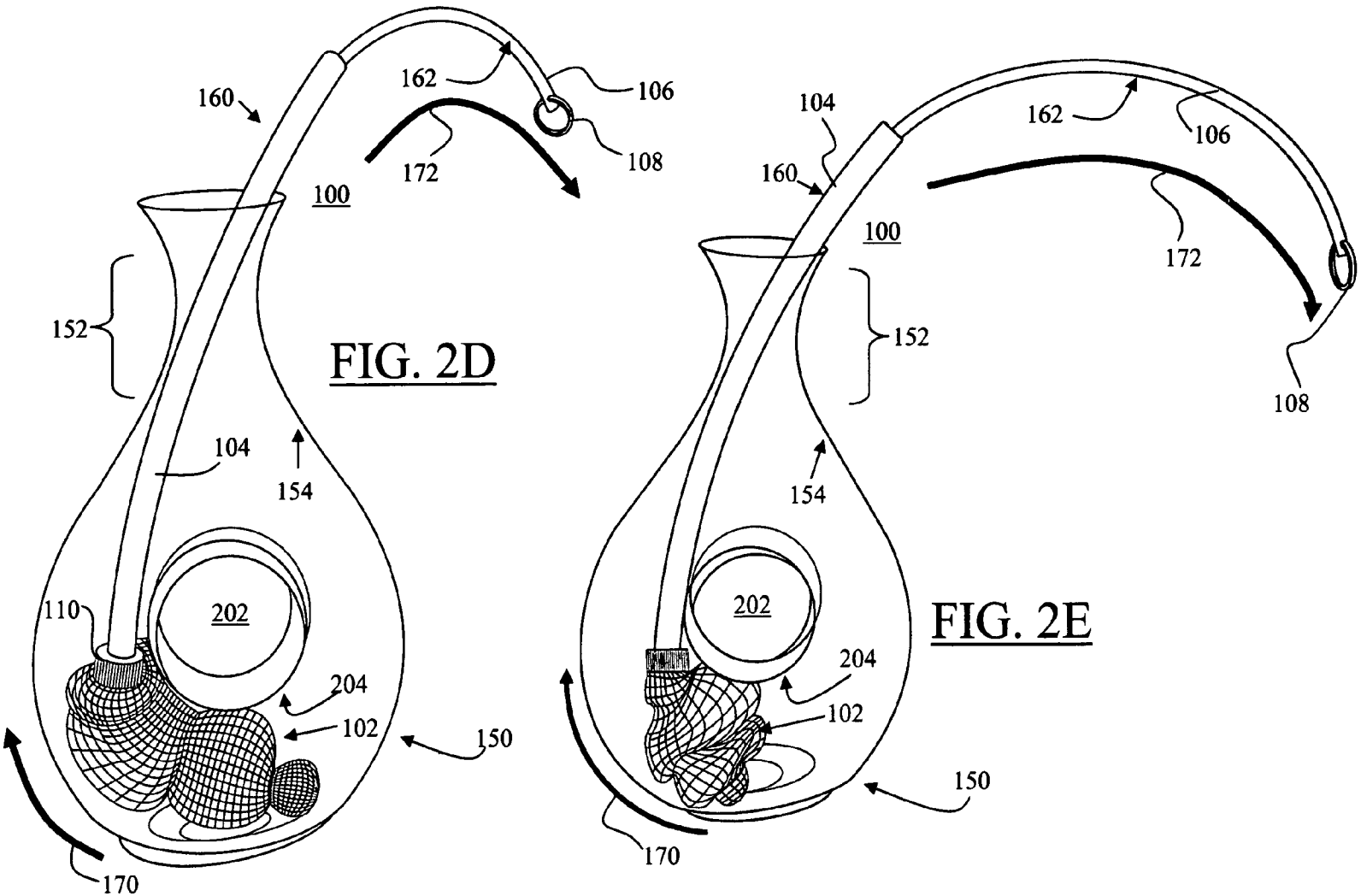

FIGS. 3A to 3D are exemplary illustrations of the cleaning mechanism illustrated in FIGS. 1A and 2E, but without the container. As illustrated in FIGS. 1A to 3D, the cleaning apparatus 100 of the present invention is comprised of a flexible elongated outer member 104, and a flexible elongated inner member 106 that is movably inserted within the outer member 104. Both the outer member 104 and the inner member 106 are in the form of an exemplary cylindrical tube. The cleaning mechanism 102 is comprised of a first end 110 coupled with the outer member 104 and a second end 120 coupled with the inner member 106. The cleaning mechanism 102 is bundled at 116 to divide it into a first, large section 112 and a second, smaller section 114, which facilitates in forming the scrunched shape of the cleaning mechanism 102 when the elongated inner member 106 is manipulated in relation to the outer member 104. A distal end of the second section 114 of the cleaning mechanism 102 is bundled together at 118, forming the dense nodule head, which is the second end 120. As further illustrated in FIGS. 1A to 3D, the inner member 106 is further comprised of an inner member second end 162 that is grasped for manipulation. The inner member second end 162 includes an attachment device 108 in the form of an exemplary loop or ring for hanging and storage of the cleaning apparatus 100 and ease of manipulation (e.g., the push-pull) of the elongated inner member 106. The elongated outer member 104, the elongated inner member 106, and the cleaning mechanism 102 are flexible allowing the cleaning apparatus 100 to move through narrow passages 152 for cleaning.

In general, the inside cross-sectional dimension of the outer member 104 is greater than the cross-sectional dimension along the transverse axial length of the inner member 106 to allow the inner member 106 to be movably inserted therein the outer member 104. The inner cross-sectional dimension of the outer member 104 is sufficiently wide to allow easy controllable movement of the elongated inner member 106, yet slight friction exists between the outer member 104 and the inner member 106 to prevent unintended sliding. The outer member 104 has a longitudinal axial length that is less than a longitudinal axial length of the inner member 106, with the longitudinal axial length of the inner member 106 being greater than a cumulative total length of the cleaning mechanism 102 when fully stretched and the longitudinal axial length of the outer member 104.

Figure 3B:
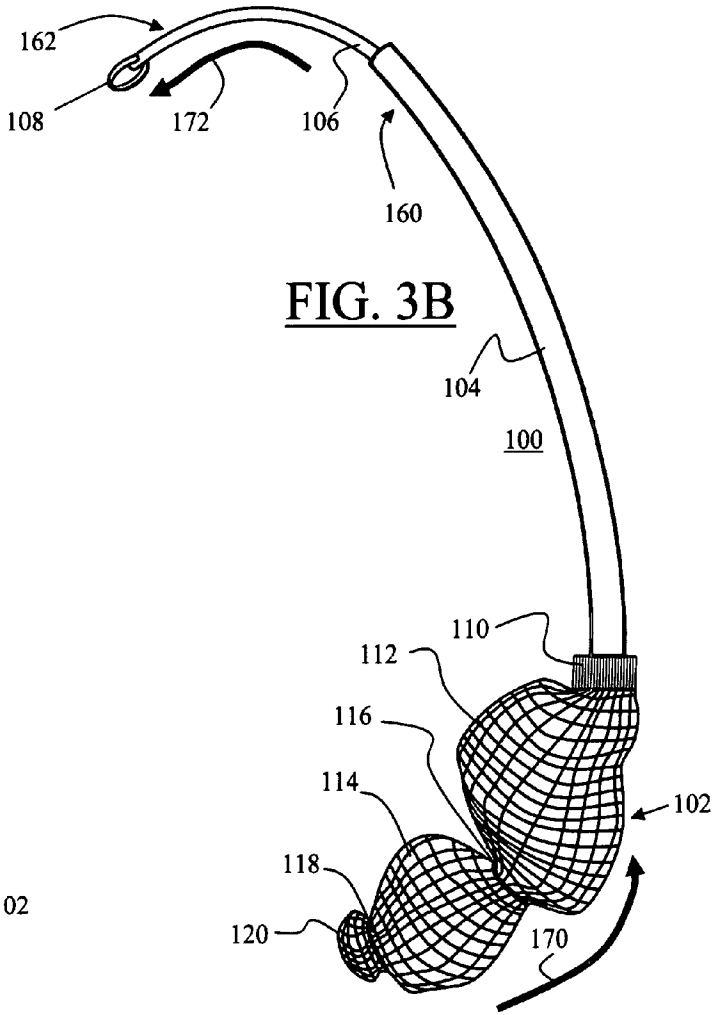
FIGS. 3A to 3D are exemplary illustration of the cleaning mechanism illustrated in FIGS. 1A to 2E, but without illustrating the container, showing the modifications of the form of the cleaning mechanism of the cleaning apparatus in accordance with the present invention.
Figure 3A:
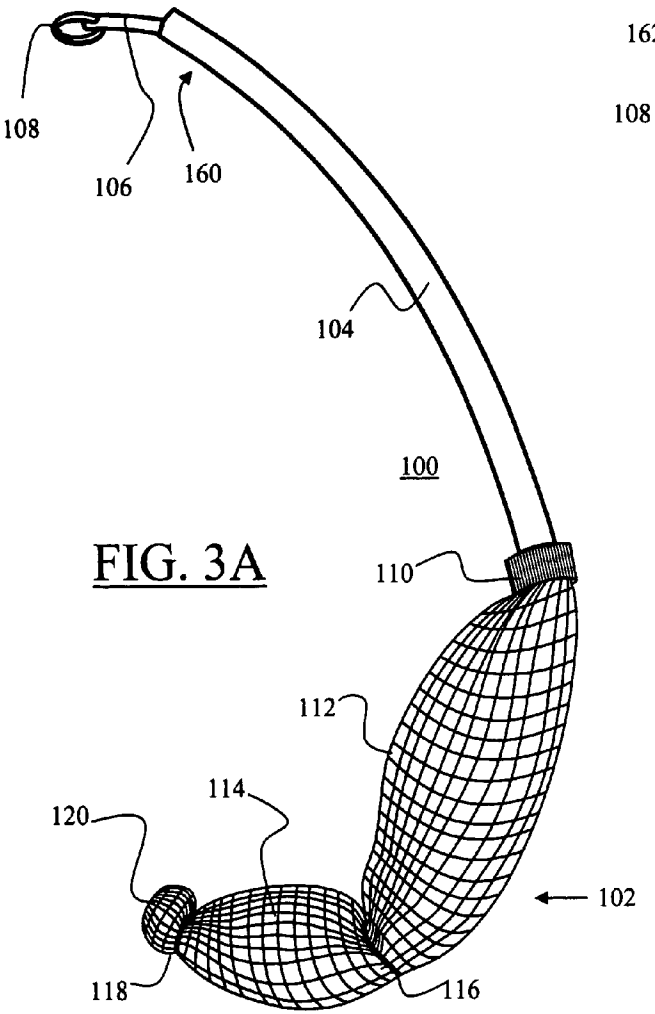
Figure 3D:
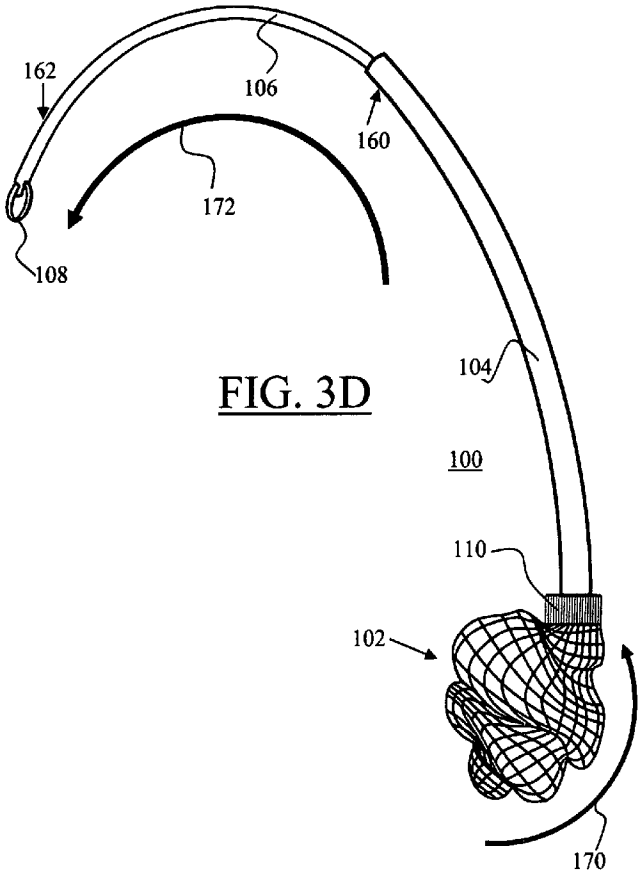
Figure 3C:
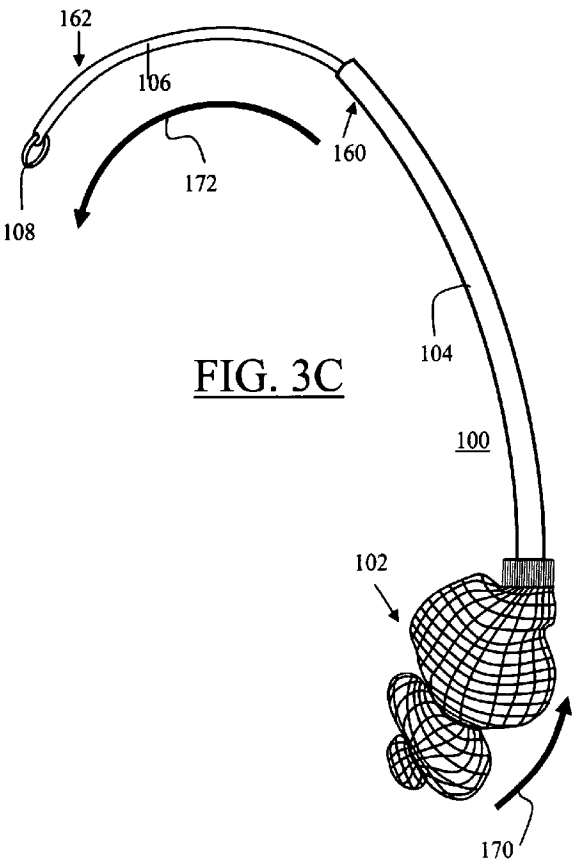

As illustrated in FIGS. 1A to 3D, the inner member 106 is manipulated to vary the form of the cleaning mechanism 102 into different shapes, allowing the cleaning mechanism 102 to be inserted through the narrow opening (or neck) 152 of a container 150, and further manipulated to continuously, progressively vary the form of the cleaning mechanism 102 into a final scrunched condensed mass, which is illustrated in FIGS. 1C, 2E, and 3D. The manipulation of the inner member 106 causes the inner member 106 to move within the outer member 104 in a first axial direction, longitudinally along the axial length of the outer member 104. The movement of the inner member 106 along the first axial direction (opposite to the direction of arrow 170) pushes the cleaning mechanism 102 away from the outer member 104. This changes the form of the cleaning mechanism 102 by drawing out and lengthening the cleaning mechanism 102 while reducing its width size for insertion of the cleaning mechanism 102 through the narrow passages 152 of exemplary containers 150. Accordingly, grasping the first end 160 of the outer member 104, and pushing the inner member 106 through the outer member 104 (opposite to the direction of arrow 172) causes the cleaning mechanism 102 to stretch, which allows it to pass through the narrow passages 152 of the containers 150.

As further illustrated FIGS. 1A to 3D, the manipulation of the elongated inner member 106 further causes the inner member 106 to move within the elongated outer member 104 in a second axial direction 172, longitudinally along the axial length of the elongated outer member 104. The movement of the inner member 106 along the second axial direction 172 pulls the cleaning mechanism 102 towards the elongated outer member 104 in the direction 170, which changes the form of the cleaning mechanism 102 by scrunching the cleaning mechanism 102 into scrunched denser form for cleaning. In particular, once passed the narrow passage 152 of the exemplary containers 150, the elongated inner member 106 is pulled by an exemplary attachment device 108 in the direction 172 while grasping and holding the outer member 104 at 160 to change the form of the cleaning mechanism 102 into a dense, scrunched form factor for cleaning. As progressively shown in the FIGS. 1B to 1C, and 2B to 2E, and 3B to 3D, as the elongated inner member 106 is pulled further and further in the direction 172, the cleaning mechanism 102 is pulled closer and closer towards the outer member 104 in the direction 170, which changes its shape or form through the various stages illustrated in the respective FIGS. 1B to 1C, and 2B to 2E, and 3B to 3D. As illustrated in FIGS. 1A to 3D, the cleaning mechanism 102 is constricted by a thin, flexible band 116 that causes the cleaning mechanism 102 to scrunch at that point when contracted by the pull of the inner member 106. As best illustrated in FIGS. 1C, 2E, and 3D the scrunched cleaning mechanism 102 within the containers 150 can then be used for cleaning. Preferably, the elongated outer member 104 and the elongated inner member 106 are slightly curved. The slight bent or curved feature of the elongated outer member 104 and the elongated inner member 106 allows for ease of cleaning of the inside of containers 150, in particular, the upper inside portions 154, the bottom area 156, and cavities 204 (caused by the hole 202) of the containers 150.

Figure 4A:
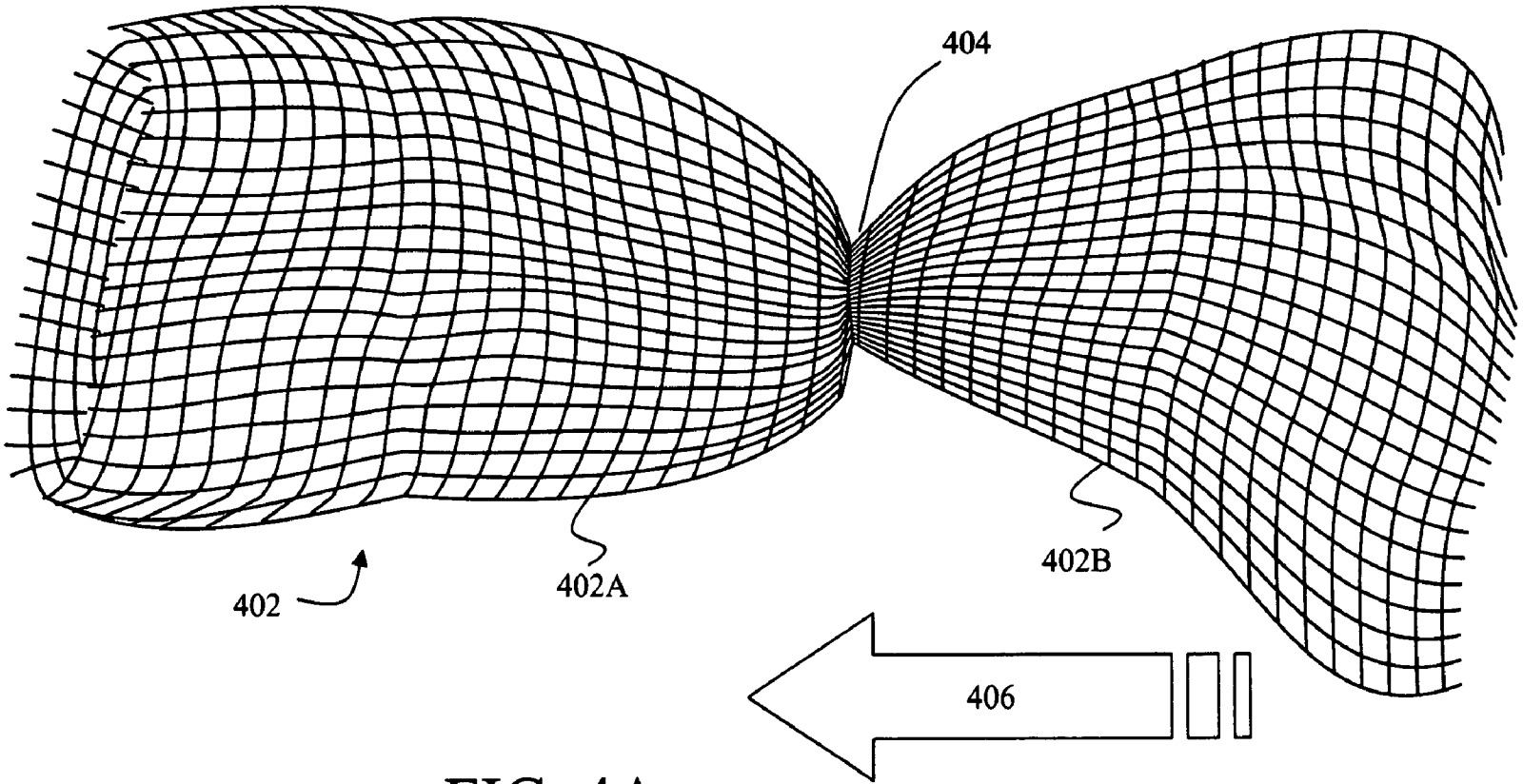
FIGS. 4A to 4G are exemplary illustrations of one, non-limiting exemplary method of manufacturing the cleaning apparatus that is illustrated in FIGS. 1A to 3D in accordance with the present invention.

FIGS. 4A to 4G are exemplary illustrations of one, non-limiting exemplary method for manufacturing the cleaning apparatus that is illustrated in FIGS. 1A to 3D, in accordance with the present invention. In general, as illustrated in FIG. 4A the cleaning mechanism 102 may be comprised of a well-known flexible, elongated tubular mesh 402 (hereinafter referred to as mesh 402). A non-limiting exemplary method for manufacturing the cleaning mechanism 102 is to have the mesh 402 be comprised of an exemplary elongated cylindrical tube mesh that is bundled and tied closed at its proximate center 404, dividing the mesh 402 into two sections 402A and 402B as illustrated in FIG. 4A. One of the sections 402A or 402B is then folded onto the other at the center bundle 404 thereof in the exemplary direction indicated by the arrow 406.

Figure 4B:
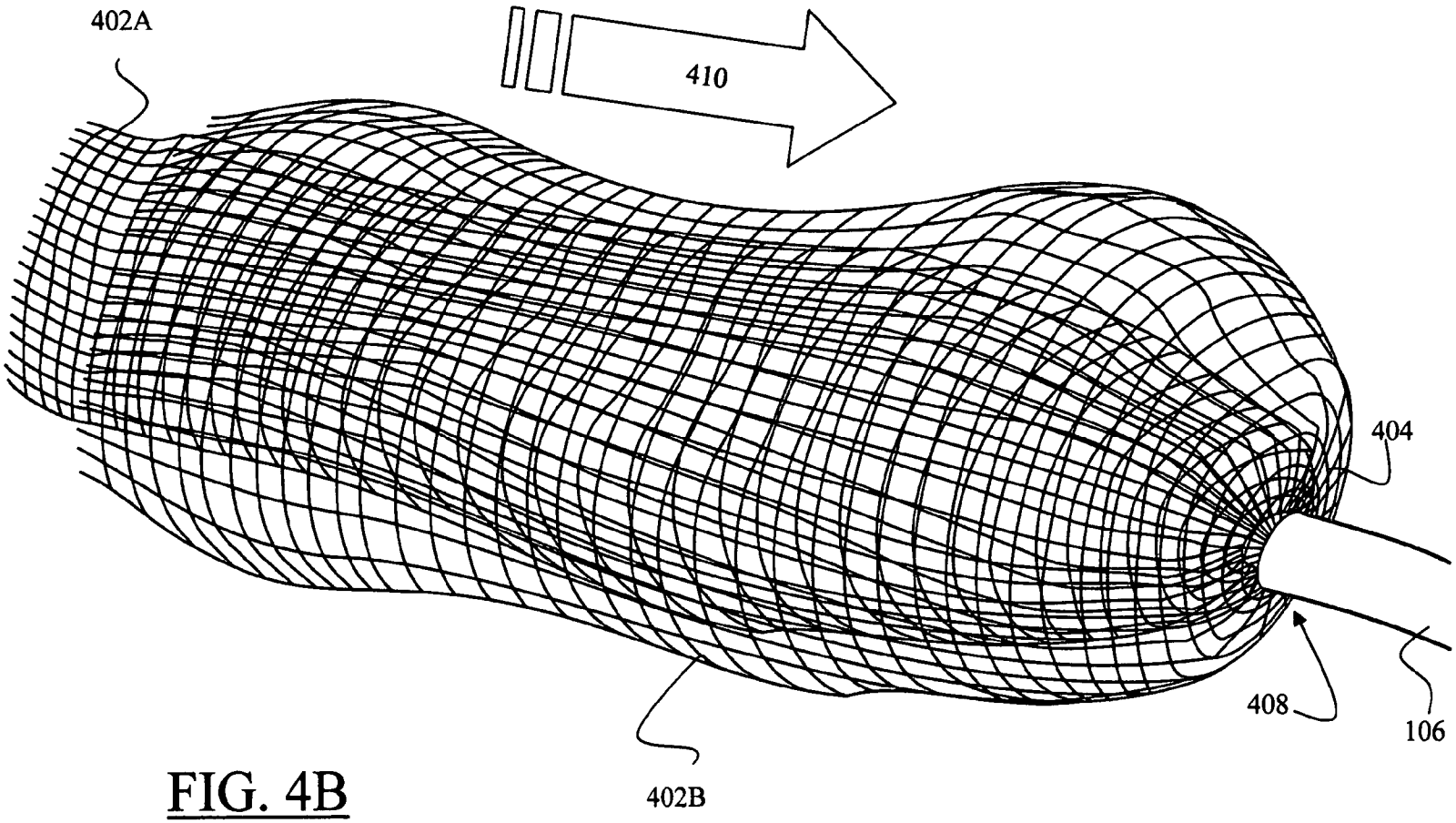
Figure 4C:
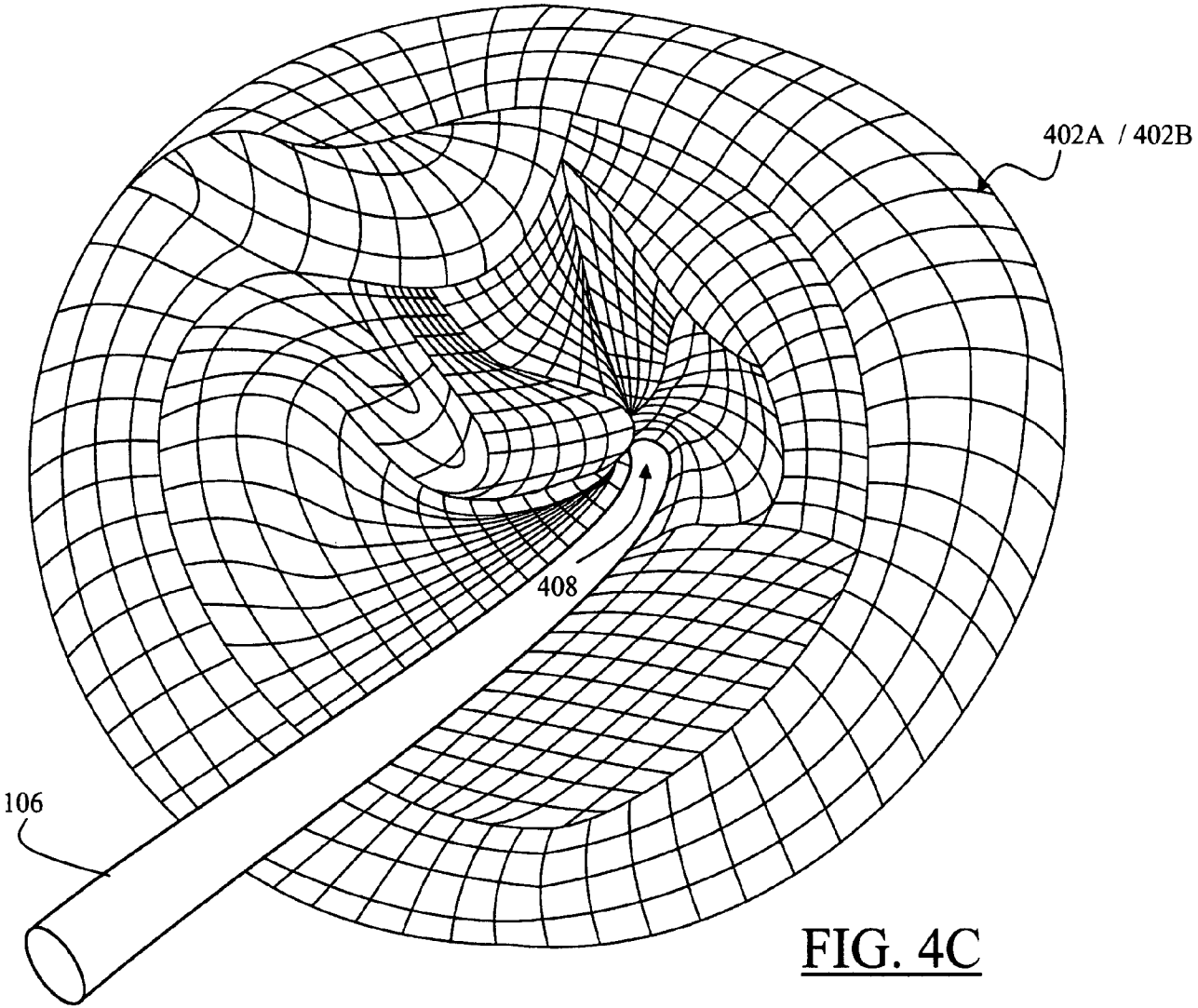
Figure 4D:
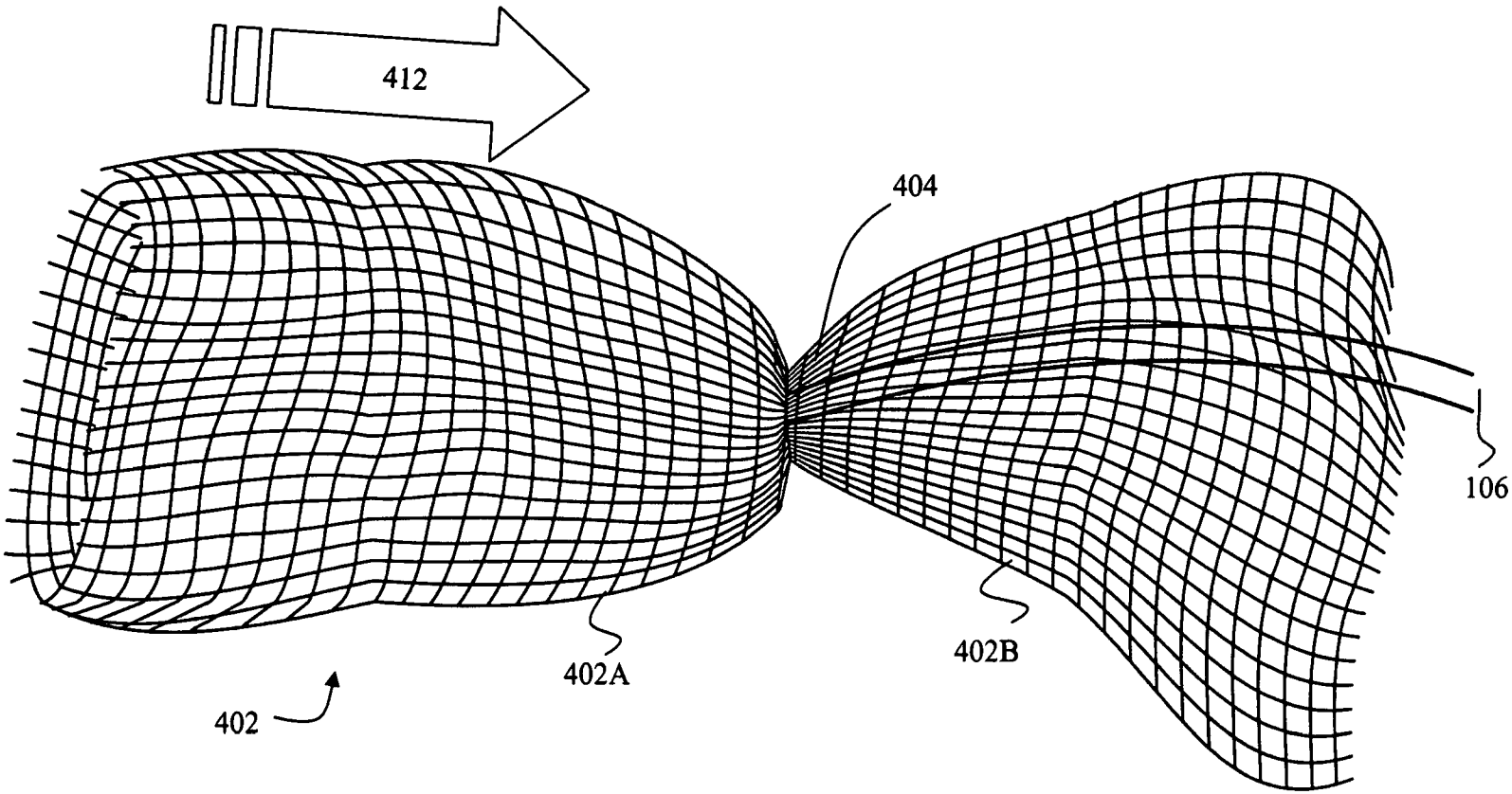
Figure 4E:
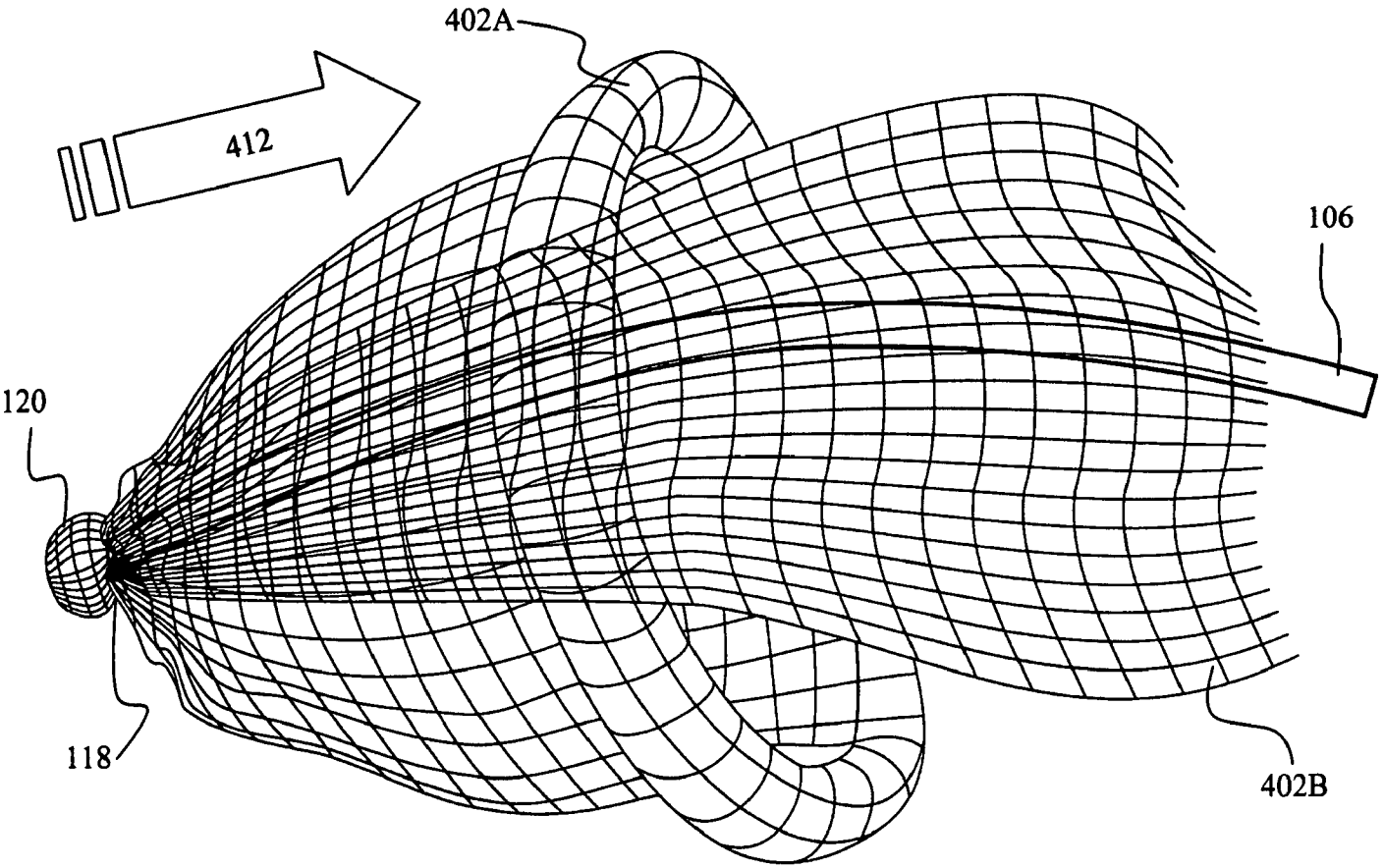
Figure 4G:
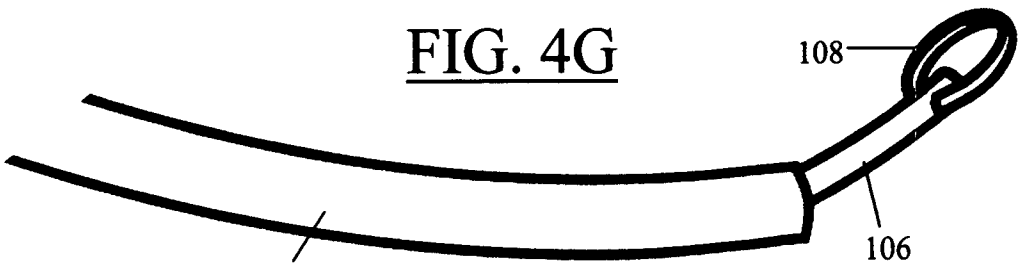
Figure 4F:
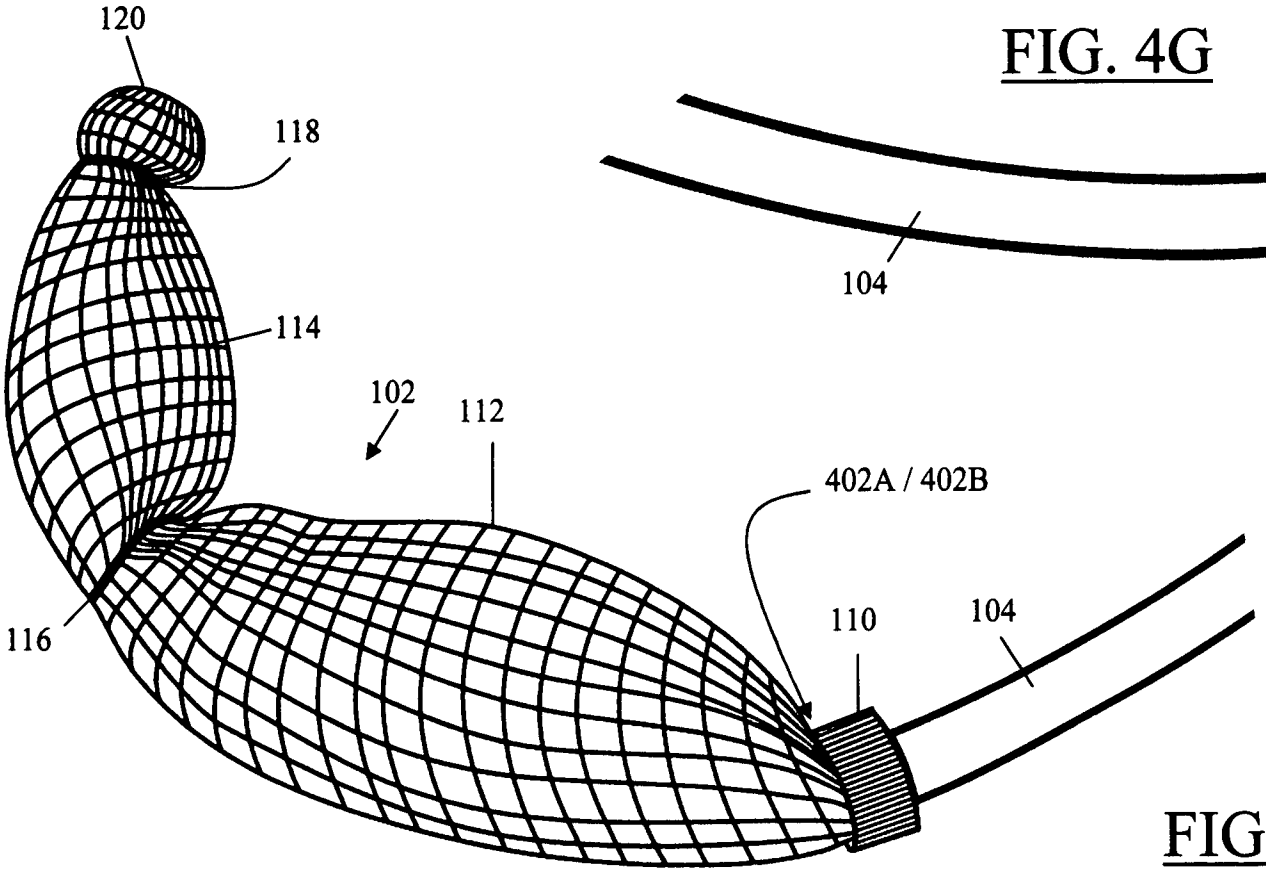

As best illustrated in FIGS. 4B and 4C, the folding exposes the interior of the center bundle 404, with which the inner member first end 408 of the elongated inner member 106 is coupled, which will eventually form the nodule dense head portion 120 of the cleaning mechanism 102. In other words, the nodule dense head portion 120 forms the second end of the cleaning mechanism 102, with the inner member first end 408 of the elongated inner member 106 coupled therewith. After the coupling of the inner member first end 408 with the interior of the center bundle 404, the second section 402B is unfolded in the direction of the arrow 410, the result of which is best illustrated in FIG. 4D. As illustrated in FIGS. 4D and 4E, once the inner member first end 408 of the inner member 106 is coupled with the interior of the center bundle 404, the section 402A is then folded onto the section 402B at the center bundle 404 thereof in the exemplary direction indicated by the arrow 412. As best illustrated in FIG. 4E, the dense nodule head 120 is formed at the second end of the cleaning mechanism 102 by tying tight the folded and bundled mesh at 118. As best illustrated in FIG. 4F, the free ends of the mesh 402 is then bundled and coupled at 110 with the elongated outer member 104, after the elongated inner member 106 is movably inserted therein the elongated outer member 104. Thereafter, as illustrated in FIG. 4G, the attachment device 108 in the form of an exemplary loop or ring is coupled with the elongated inner member 106. In general, the coupling of all members is preferably through some type of adhesive or plastic or synthetic welding, depending on manufacturing techniques. Regardless of the attachment method used, the coupling should provide secure attachment (assembly), and withstand the environment within which the cleaning apparatus 100 is used.

Although the invention has been described in considerable detail in language specific to structural features and or method acts, it is to be understood that the invention defined in the appended claims is not necessarily limited to the specific features or acts described. Rather, the specific features and acts are disclosed as preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. For example, the inner member and the outer member may comprise of any cross-section, transverse along their respective longitudinal axis, and need not be limited to circular. In other words, the inner member and the outer member need not be limited to round shaped tubes. The dimensions of the entire cleaning apparatus and its corresponding components may be varied to clean various size containers. Non-limiting examples of materials used for the cleaning apparatus 100, including the cleaning mechanism 102 may include plastic, metal, non-mesh cloth, etc. The materials from which the components of the cleaning apparatus 100 are comprised of may vary. In other words, the material that constitutes the cleaning mechanism 102 may be different from that of other components such as the elongated inner member 106 or the elongated outer member 104. For example, the cleaning mechanism 102 may comprise of a copper mesh and the elongated inner member 106 be made of plastic. Any type of coupling and manufacturing technique appropriate for producing the cleaning apparatus 100 may be used. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, proximal, distal, parallel, perpendicular, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A flexible cleaning apparatus for cleaning a curved surface and comprising:

a flexible cleaning mechanism adapted to be stretched to an elongated shape having a narrow configuration and contracted to a condensed mass with an expanded shape having a wide configuration relative to said narrow configuration;

a resiliently flexible outer member having a first end and second end;

a resiliently flexible inner member to bend around the curved surface to be cleaned, said inner member positioned within said outer member and having a first distal working end and a second handle end;

said outer member has a longitudinal axis length that is less than a second longitudinal axis length of the inner member such that said inner member handle end and working end respectively extend beyond said outer member first and second end;

said flexible inner member being movable through said flexible outer member in response to a pulling or pushing force applied to said handle end, the first distal working end of said flexible inner member coupled to said flexible cleaning mechanism so that said cleaning mechanism is stretched or contracted between said elongated shape and said condensed mass expanded shape depending upon whether a pulling or a pushing force is applied to said inner member handle end;

said flexible cleaning mechanism being wrapped at one end thereof around, bunched to form a dense nodule head, and enclosing the distal working end of said flexible inner member and extending from the distal working end of said flexible inner member to couple with said flexible outer member, so that said flexible cleaning mechanism is bendable with said flexible inner member upwardly, downwardly and sideways around the curved surface to be cleaned, wherein said flexible cleaning mechanism is a tubular mesh that is folded back and over itself to establish said inner and outer layers lying one above the other, and wherein ends of said inner and outer layers of said flexible cleaning mechanism opposite said distal end of said flexible inner member are attached to an outer surface of said flexible outer member by a coupler member.

2. The flexible cleaning apparatus recited in claim 1, wherein said mesh being flexible so that the elongated and expanded shapes of said cleaning mechanism are asymmetrical with respect to said flexible inner member when said cleaning mechanism is bent with said flexible inner member around the curved surface to be cleaned.

3. The flexible cleaning apparatus recited in claim 1, wherein the first end of said flexible cleaning mechanism moving with said flexible inner member relative to the opposite end of said flexible cleaning mechanism, whereby said flexible cleaning mechanism is pulled towards said flexible outer member and contracted to said expanded shape in response to the pulling force applied to the second handle end of said flexible inner member, and said cleaning mechanism is pushed away from said flexible outer member and stretched to said elongated shape in response to the pushing force applied to the second handle end of said flexible inner member.

4. The flexible cleaning apparatus recited in claim 1, wherein said flexible outer member is a hollow tube and said flexible inner member is a tube that slides through said outer member tube, said flexible inner member tube extending completely through said flexible outer member tube.

5. The flexible cleaning apparatus recited in claim 4, wherein each of the hollow tube of said flexible outer member and the tube of flexible inner member is curved.

* * * * *